US007055188B2

(12) United States Patent
Ross et al.

(10) Patent No.: US 7,055,188 B2
(45) Date of Patent: Jun. 6, 2006

(54) WATER-RETENTION DAM FOR SHOWER

(75) Inventors: Kevin Ross, Plymouth, MA (US); Richard A. Millard, Jr., Richmond, VA (US)

(73) Assignee: KR Specialties, Kingston, MA (US)

( * ) Notice: Subject to any disclaimer, the term of this patent is extended or adjusted under 35 U.S.C. 154(b) by 0 days.

(21) Appl. No.: 10/824,849

(22) Filed: Apr. 15, 2004

(65) Prior Publication Data

US 2005/0229303 A1 Oct. 20, 2005

(51) Int. Cl.
*A47K 3/22* (2006.01)

(52) U.S. Cl. ..... 4/609

(58) Field of Classification Search ..... 4/596, 4/605, 609, 612–614; 52/34, 35; 49/467–471
See application file for complete search history.

(56) References Cited

U.S. PATENT DOCUMENTS

| | | | | |
|---|---|---|---|---|
| 2,862,261 | A * | 12/1958 | Quoss | 49/468 |
| 3,148,419 | A * | 9/1964 | Straus, et al. | 49/469 |
| 4,387,535 | A * | 6/1983 | Corbo | 49/468 |
| 6,094,757 | A * | 8/2000 | Torres | 4/613 |
| 6,735,793 | B1 * | 5/2004 | Peterson | 4/613 |
| 6,877,279 | B1 * | 4/2005 | Russell et al. | 49/498.1 |

FOREIGN PATENT DOCUMENTS

DE 3514489 A1 * 10/1986

* cited by examiner

*Primary Examiner*—Justine R. Yu
*Assistant Examiner*—Huyen Le
(74) *Attorney, Agent, or Firm*—Fish & Richardson P.C.

(57) ABSTRACT

A water retention dam including a collapsible outer shell having an inner chamber and at least one surface for preventing the passage of water. The outer shell has a first surface configured to serve as a barrier to water and a second surface for attachment to a floor. The second surface has a recess for receiving an adhesive.

21 Claims, 4 Drawing Sheets

WATER-RETENTION DAM FOR SHOWER

TECHNICAL FIELD

The present invention relates to showers for bathing.

BACKGROUND

Standard showers for bathing generally include an apron for retaining water during use. In shower/bathtub combinations, the wall of the bathtub serves as the apron. On the other hand, shower-only facilities include a shower basin having a molded flange or lip for maintaining water within the shower.

SUMMARY

In a general aspect of the invention, a water retention dam includes a collapsible outer shell having an inner chamber and at least one surface for preventing the passage of water, the outer shell having a first surface configured to serve as a barrier to water and a second surface for attachment to the floor. The second surface has a recess for receiving adhesive.

Embodiments of this aspect of the invention may include one or more of the following features. The outer shell is rubber with a first surface that is arch-shaped, and it includes an air-filled chamber. The water-retention dam further includes a tape positioned within the recess. The adhesive is water-resistant and is applied to the tape. The tape is also water-resistant.

Among other advantages, the water retention dam has the ability to absorb the impact energy of a rolling wheelchair or foot, while maintaining water within the shower during use. The water retention dam is particularly advantageous for persons with temporary or permanent disabilities where use of a conventional shower would be more difficult or impossible.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
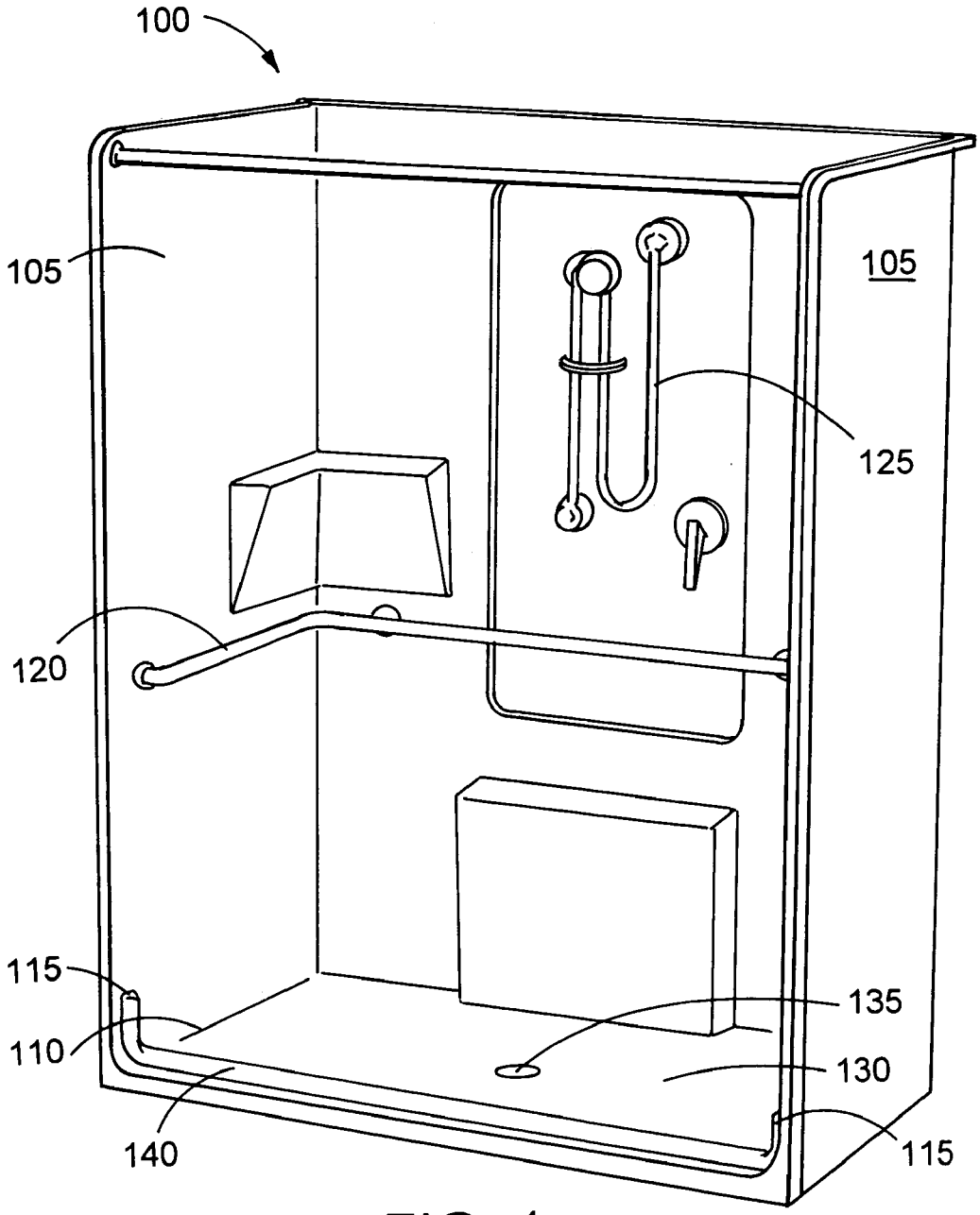
FIG. 1 is a perspective view of a handicap shower.

Referring to FIG. 1, a barrier-free, curbless shower 100 is shown having a one-piece molded fiberglass construction and a slip-resistant floor 130. Unlike standard tub/showers, curbless shower 100 does not include an apron. Thus, access into and out of curbless shower 100 is made easier, an advantage for senior citizens and the handicapped (e.g., those requiring a wheelchair). Shower 100 includes handrails 120, a shower wand assembly 125 attached to the walls 105 of the shower, and a drain 135 recessed within shower floor 130.

Figure 2A:
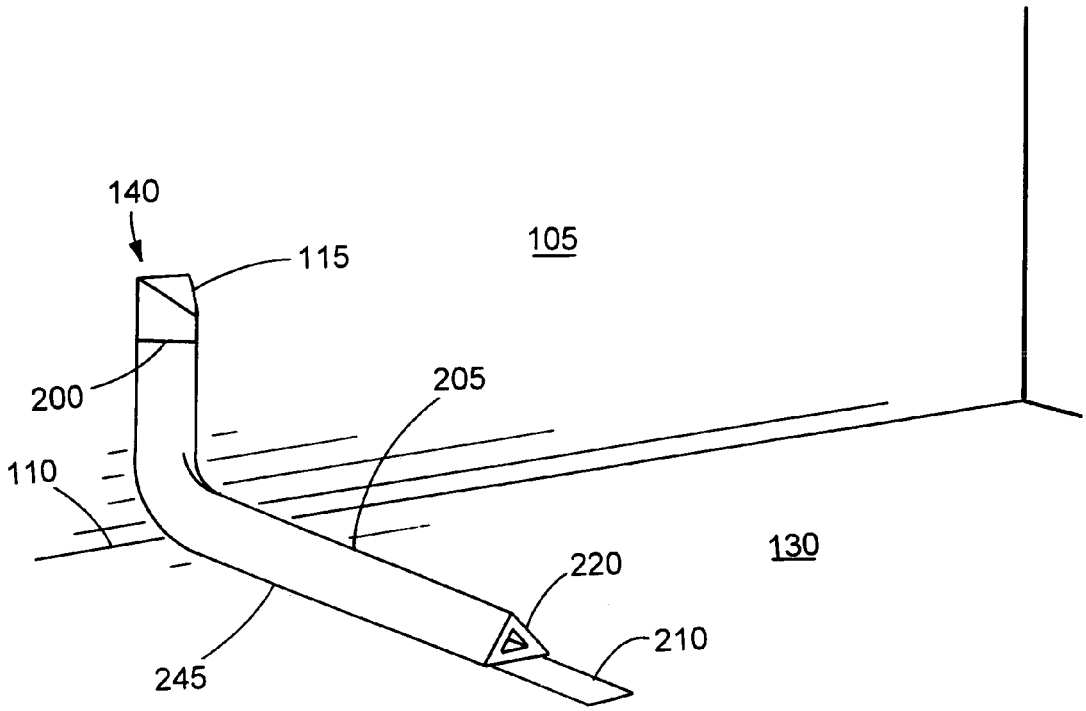
FIG. 2A is a perspective view of a collapsible dam.
Figure 2B:
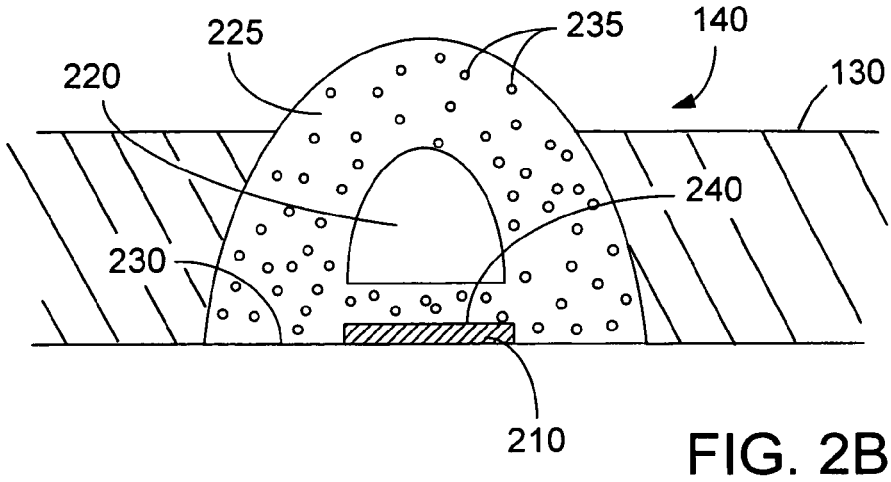
FIG. 2B is an enlarged cross-sectional front view of the collapsible dam of FIG. 2A.

Referring to FIGS. 2A and 2B, shower 100 includes a water retention collapsible dam 140 for maintaining water within the shower during use. Water retention collapsible dam 140 is in the form of an elongated member 205 having a flat lower surface 230 (FIG. 2B) that contacts floor 130 and a curved upper surface 225. In this embodiment, curved upper surface 225 is in the shape of a dome and has a generally triangular cross-section.

Collapsible dam 140 is made from a compressible material (e.g., a closed cell Ethylene-Propylene-Diene-Monomer (EPDM) sponge rubber) which contains porous holes 235. The material is preferable fingus resistant. At its core, collapsible dam 140 includes a cylindrical air-filled passage 220 extending along its entire length to further enable the compressibility of the darn.

The bottom of flat lower surface 230 includes a recessed groove 240 which holds a strip of self-adhesive tape 210 for firmly holding the dam to slip-resistant floor 130. Adhesive tape 210 is water resistant for durability in the shower setting, and is double-sided to permit easy attachment to recessed groove 240 and to shower floor 130. In order to allow collapsible dam 140 to spread the impact energy from a rolling wheelchair or foot along the length of the dam, adhesive tape 210 does not extend to the end tips 200 (FIG. 2A) of collapsible dam 140. Although, in other embodiments, adhesives can be substituted for self-adhesive tape 210, using tape 210 provides a simple and clean method for attaching collapsible dam 140 to floor 130.

Collapsible dam 140 extends along shower floor 130 (FIG. 2A) to the wall radius 110. Dam 140 then curves upwardly along shower wall 105. End caps 115 can be attached at the end tip 200 of collapsible dam 140. Installation of end caps 115 helps to seal elongated structure 205 and to provide a finished look. End caps 115 also can keep the shower curtain inside collapsible dam 140.

In one embodiment, using a properly sized curtain with heavy tape weights in combination with collapsible dam 140 effectively prevents water spillage. In addition, the outer edges 245 beneath collapsible dam 140 may be caulked to prevent soap and shower debris from lodging beneath collapsible dam 140.

Figure 3:
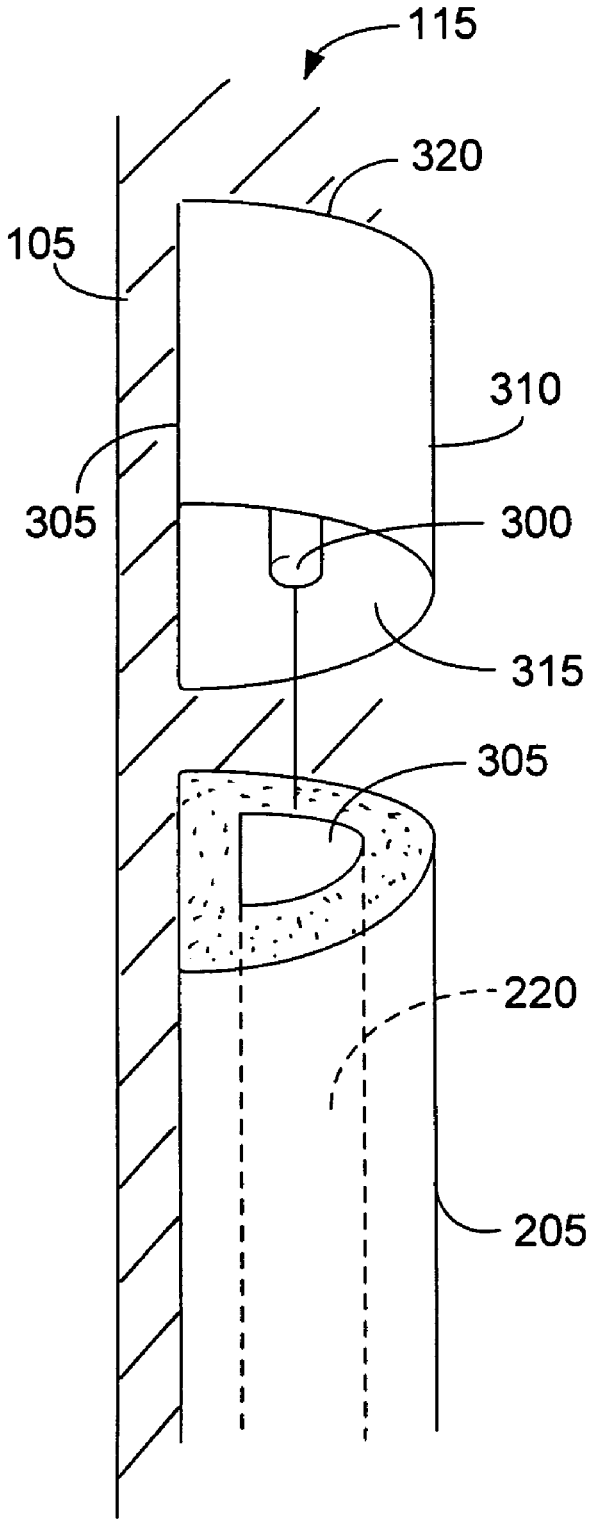
FIG. 3 is a side view of the end cap and collapsible dam of FIG. 2A.

Referring to FIG. 3, end cap 115 is a four-sided figure with a flat bottom surface 305 having contact with shower wall 105, a curved upper surface 310 directly opposite to flat surface 305, and a first side surface 320 and a second side surface 315 located at the polar ends. In this embodiment, curved upper surface 310 is in the arch-shape of a dome and has a generally triangular-cross section. First side surface 320 is sloped inwardly and located distally from elongated structure 205, while second side surface 315 is located proximally and attaches to elongated structure 205. Second side surface 315 features a recessed interior with plug 300 which protrudes from its center. Plug 300 fits snugly into opening 305 of air-filled passage 220, thus sealing the water-retention collapsible dam.

Figure 4:
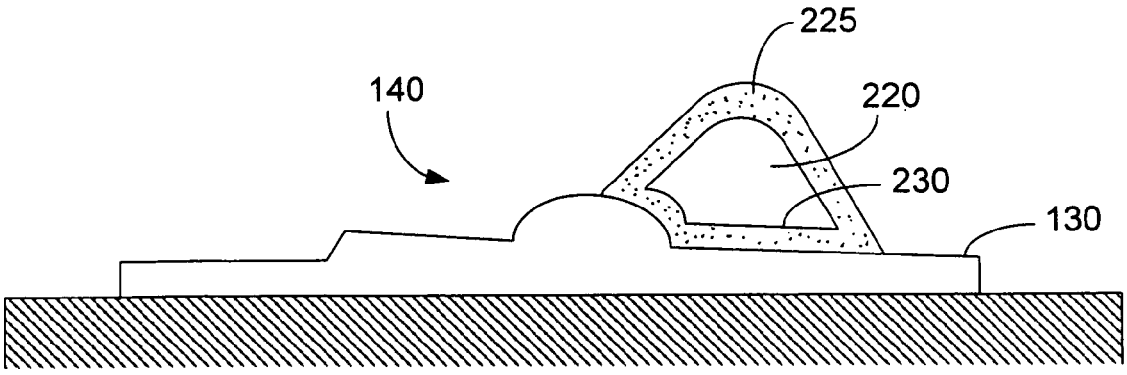
FIG. 4 is an alternative embodiment of a collapsible dam.

Another embodiment (FIG. 4) shows water-retention collapsible dam 140 attached to shower floor 130 at an elevated angle.

In other embodiments, curved upper surface 225 may be formed in a shape other than a dome, so long as collapsible dam 140 maintains the functionality of retaining water within the shower during use.

The foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Thus, it will be apparent to those skilled in the art that many changes and substitutions can be made to the preferred embodiment described without departing from the spirit and scope of the present invention as defined by the following claims.

What is claimed is:

1. A water-retention system for use in a barrier-free or curbless handicapped shower, the water retention system comprising:

a threshold including a collapsible outer shell, the outer shell having an inner chamber, at least one surface for preventing the passage of water, and a first surface configured to serve as a barrier to water and a second surface for attachment to a floor, the second surface having a recess for receiving an adhesive; and end caps attached at ends of the collapsible outer shell.

2. The water-retention system as recited in claim 1 wherein said collapsible outer shell is compressible foam.

3. The water-retention system as recited in claim 1 wherein said collapsible outer shell includes an air-filled chamber.

4. The water-retention system as recited in claim 3 wherein the air-filled chamber enables compression of the collapsible outer shell.

5. The water-retention system as recited in claim 1 wherein said first surface is arch-shaped.

6. The water-retention system as recited in claim 1 further comprising an adhesive tape positioned within the recess, the adhesive applied to the tape.

7. The water-retention system as recited in claim 6, wherein the adhesive is water-resistant.

8. The water-retention system as recited in claim 6, wherein the tape is water-resistant.

9. The water-retention system as recited in claim 1 wherein said first surface has a generally triangular cross section.

10. The water-retention system as recited in claim 1 wherein the collapsible outer shell is sized and shaped to retain a shower curtain inside the bathing area.

11. A water-retention system for use in a barrier-free or curbless handicapped shower, the water retention system comprising: a threshold including a collapsible outer shell, the outer shell having at least one surface for preventing the passage of water, and a first surface configured to serve as a barrier to water and a second surface for attachment to a floor, the second surface having a recess for receiving an adhesive, and an air-filled chamber, wherein a plug seals the opening of the air-filled chamber.

12. A water-retention system for use in a barrier-free or curbless handicapped shower, the water retention system comprising:

a threshold including a collapsible outer shell, the outer shell having an inner chamber, at least one surface for preventing the passage of water, and a first surface configured to serve as a barrier to water and a second surface for attachment to a floor, the second surface having a recess for receiving an adhesive, wherein the collapsible outer shell extends vertically along the walls of a water-retention area.

13. The water-retention system as recited in claim 12 wherein the vertically extending extension is configured to absorb the impact energy of passage across the threshold.

14. The water-retention system as recited in claim 12 wherein said collapsible outer shell is compressible foam.

15. The water-retention system as recited in claim 12 wherein said collapsible outer shell includes an air-filled chamber.

16. The water-retention system as recited in claim 15 wherein the air-filled chamber enables compression of the collapsible outer shell.

17. The water-retention system as recited in claim 12 wherein said first surface is arch-shaped.

18. The water-retention system as recited in claim 12 further comprising an adhesive tape positioned within the recess, the adhesive applied to the tape.

19. The water-retention system as recited in claim 18, wherein the adhesive is water-resistant.

20. The water-retention system as recited in claim 18, wherein the tape is water-resistant.

21. A water-retention threshold comprising:

a collapsible outer foam shell, the collapsible outer shell attaching to a floor and extending vertically along the walls of a water-retention area, the vertically extending extension configured to absorb the impact energy of passage across the threshold;

an air-filled inner chamber, the air-filled inner chamber enabling compression of the collapsible outer shell;

at least one surface configured to serve as a barrier to water, the water-barrier surface being arch-shaped and having a generally triangular cross-section;

a second surface for attachment to a floor, the second surface having a recess for receiving a water-resistant adhesive tape; and end caps to seal the air-filled inner chamber, the end caps attaching at the end tips of the collapsible outer shell.

* * * * *